United States Patent [19]

Ruano

[11] 4,042,142

[45] Aug. 16, 1977

[54] BEER KEG COOLING CONTAINER

[76] Inventor: Robert W. Ruano, 2711 Locust Drive, Pittsburgh, Pa. 15241

[21] Appl. No.: 682,050

[22] Filed: Apr. 30, 1976

[51] Int. Cl.[2] ..... B65D 7/24; A47J 27/10

[52] U.S. Cl. ..... 220/4 B; 62/372; 62/395; 62/400; 220/9 F; 220/13; 220/71; 220/94 R; 220/DIG. 6

[58] Field of Search ..... 220/4 B, 4 E, 9 F, 13, 220/17, 71, 94 R, ; 206/2; 222/146 C, 183; 62/372, 394, 395, 400, 467

[56] References Cited

U.S. PATENT DOCUMENTS

| | | | |
|---|---|---|---|
| 81,814 | 9/1968 | Nuellens et al. | 62/400 X |
| 1,670,158 | 5/1928 | Klug | 206/2 |
| 2,054,699 | 9/1936 | Geyer | 206/2 X |
| 2,088,376 | 7/1937 | Kaskey | 62/400 X |
| 2,104,467 | 1/1938 | Marzolf | 222/146 C X |
| 3,231,143 | 1/1966 | Cserny | 222/183 |
| 3,232,491 | 2/1966 | Hunt | 222/183 X |
| 3,315,491 | 4/1967 | Zant | 62/372 X |
| 3,506,161 | 4/1970 | Saint-Dizier | 222/183 |
| 3,627,399 | 12/1971 | Addison et al. | 222/146 C X |
| 3,789,622 | 2/1974 | Yanes | 62/400 X |
| 3,810,367 | 5/1974 | Peterson | 62/372 X |

*Primary Examiner*—Stephen Marcus
*Attorney, Agent, or Firm*—William J. Ruano

[57] ABSTRACT

A beer keg container of insulating material, such as styrofoam, subdivided into three parts, a lid with a hole through which the shaft of the tap extends, an upper half, and a bottom half, which halves are detachably connected by an interlocking joint. The bottom half is reinforced with a wire basket having handles to facilitate carrying of the insulating container and enclosed beer keg. The diameter of the beer keg is smaller and spaced from the inner diameter of the container so that the space therebetween may be packed with ice cubes or crushed ice to keep the beer keg cold.

5 Claims, 8 Drawing Figures

BEER KEG COOLING CONTAINER

This invention relates to an insulating container for a beer keg, although it is suitable for kegs containing other liquids, and is for the purpose of keeping the liquid contents of the keg cool during outings, parties and the like.

An outstanding disadvantage of the common practice of keeping a beer keg cold by inserting it into a tub containing ice is the additional weight of the tub to be carried, the accumulation of liquid in the tub from the melting ice and the awkwardness of the entire assembly.

In the past, kegs having liquid contents have been encased in an insulating covering to prevent loss of heat or cold from the liquid contents of the keg. However, this has not been found satisfactory since no provision has been made for additional cooling of the contents of the keg.

An object of my invention is to provide a novel beer keg insulating container which overcomes the above-named disadvantages and which is extremely light in weight, easy to transport and yet highly effective in keeping the keg cool even on very warm days.

A more specific object of my invention is to provide a novel insulating container which is so designed as to receive a layer of crushed ice which will completely surround the keg so as to keep it cool and which includes reinforcing means together with handles for the lower portion of the container to enable easy transportation from one location to another.

Other objects and advantages will become more apparent from a study of the following description taken with the accompanying drawings wherein.

Figure 1:
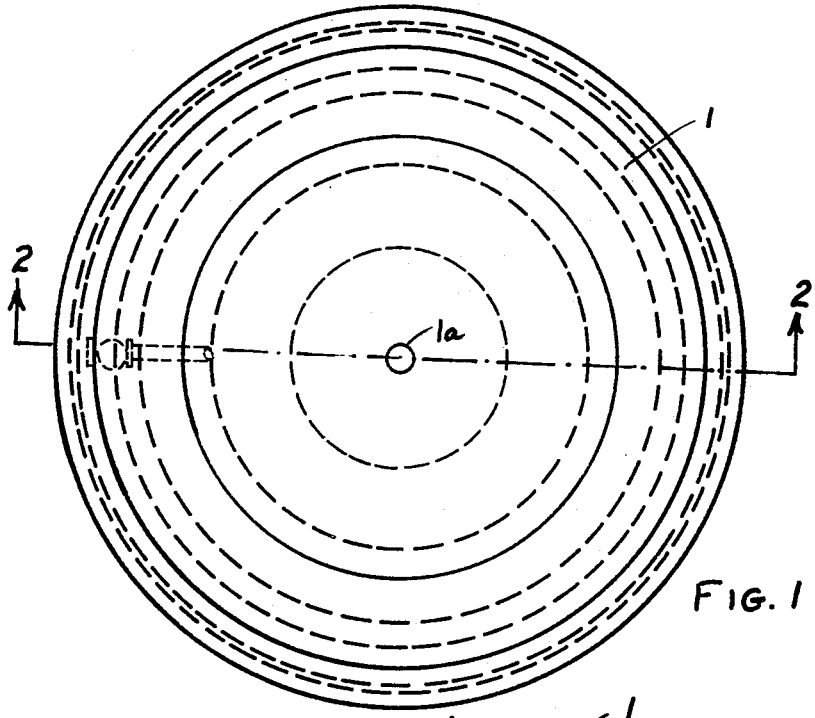
FIG. 1 is a top view of the insulating container embodying features of the present invention.
Figure 2:
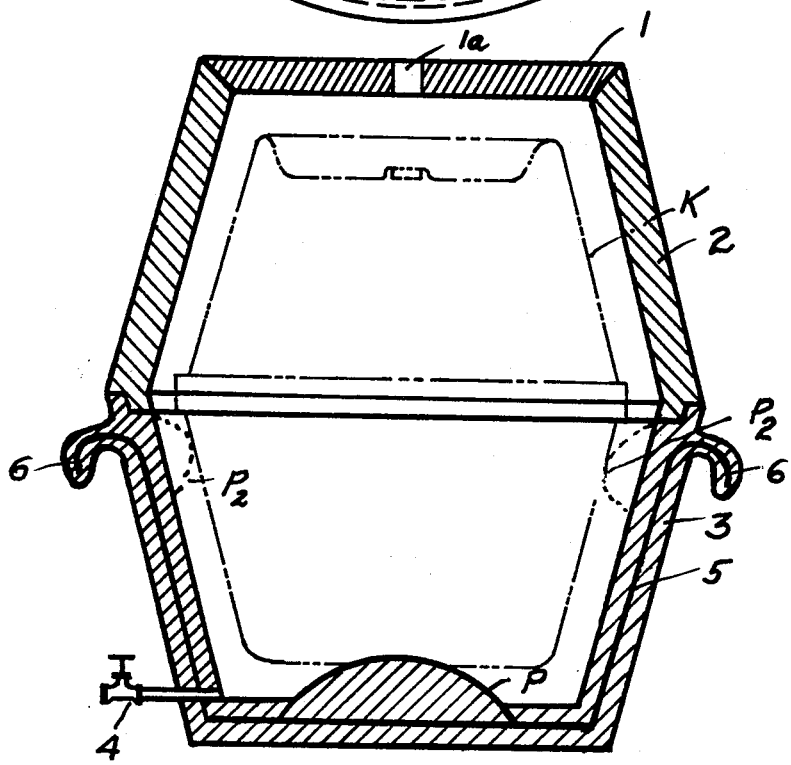
FIG. 2 is a vertical, cross-sectional view thereof taken along line 2—2 of FIG. 1.
Figure 3:
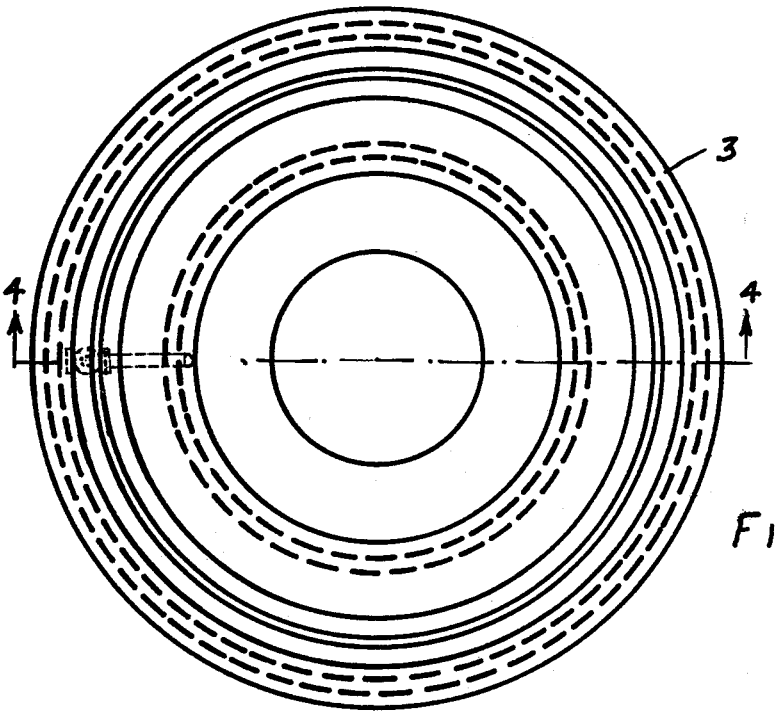
FIG. 3 is a top view of the bottom half of the container.

Referring more particularly to FIGS. 1 and 2 of the drawing, the letter K in dash and dot outline in FIG. 2, denotes a beer keg or a keg of other liquid, having an inverted well portion at the center of the bottom thereof which mates with an upward projection P in the lower half of the insulating container to provide a spacing for receiving ice cubes or crushed ice between the keg and container throughout the entire inner walls of the container. The lid 1 of the insulating container has a central hole 1*a* to accommodate the shaft of a tap (not shown). The lid is chamfered about its perimeter so as to snugly fit a correspondingly shaped top peripheral edge of the upper container part 2. The lower peripheral portion of container part 2 is grooved to provide an interlocking fit with the mouth portion at the top of the lower half 3 of the container. Parts 1, 2 and 3 of the container are made of any suitable temperature insulating material, preferably Styrofoam because of its light weight. Optionally, a drain faucet 4 is provided for draining melted ice from time to time.

Figure 7:
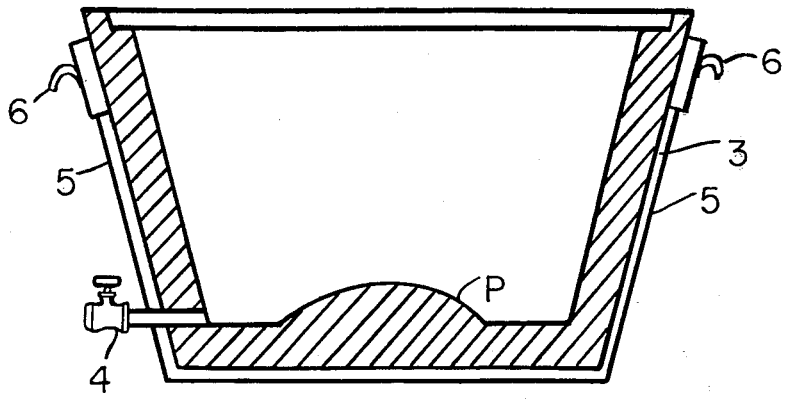
FIG. 7 is a vertical cross-sectional view of a modification.
Figure 8:
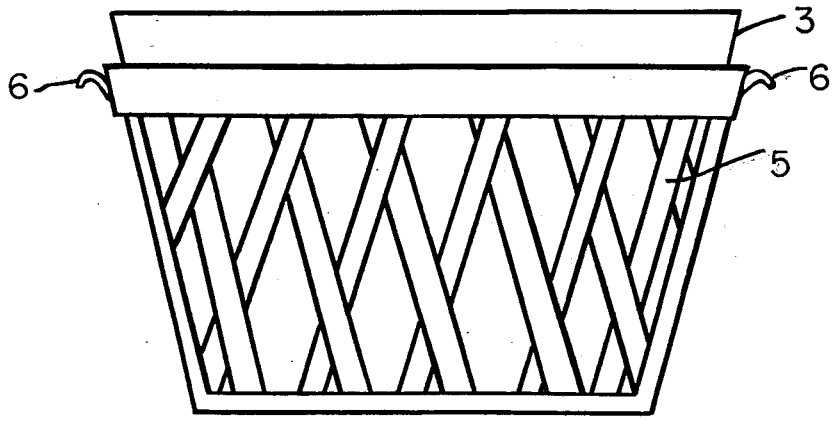
FIG. 8 is a side view thereof.

The lower half 3 of the insulated container is preferably reinforced with a wire basket 5 having a pair of handles 6, which handles may or may not be embedded in the insulating material of lower part 3 of the container. Instead of embedding the wire basket 5 in the insulating material, as shown, the basket may be contained either snugly against the inner walls or the outer walls of the insulated part 3 with the handles projecting outwardly near the top thereof without an insulating covering. The latter modification is shown is shown in FIGS. 7 and 8. Also, the basket could be of a continuous sheet material instead of a net or weave, if desired instead.

Figure 4:
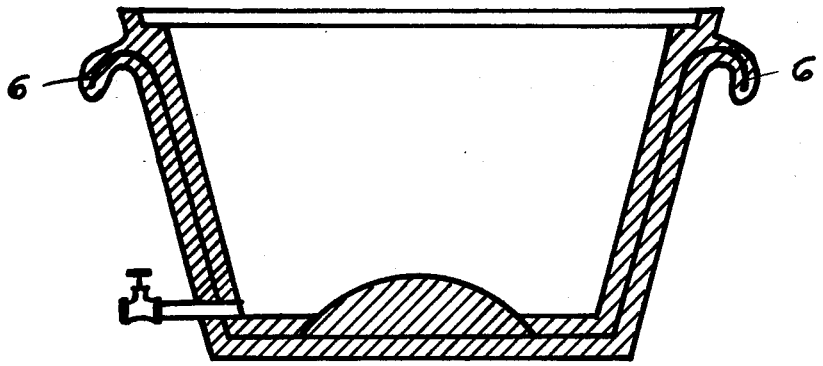
FIG. 4 is a vertical, cross-sectional view taken along line 4—4 of FIG. 3.
Figure 5:
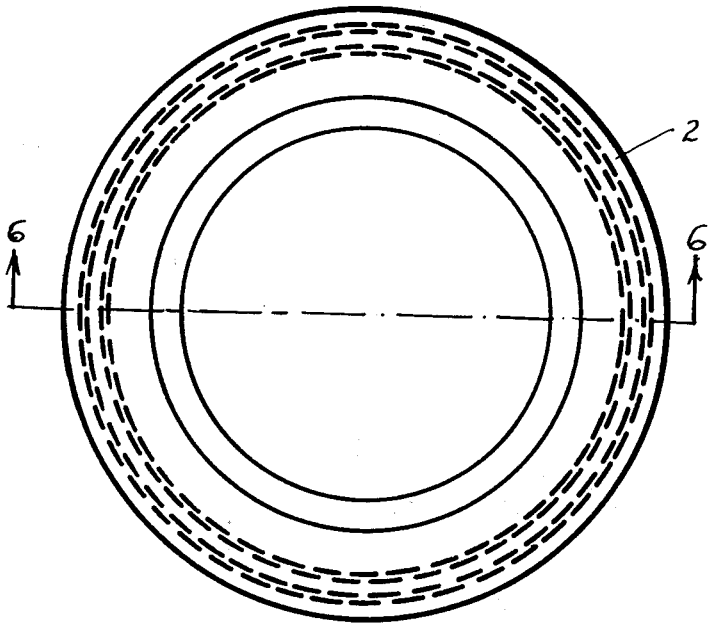
FIG. 5 is a top view of the top half of the insulating container.
Figure 6:
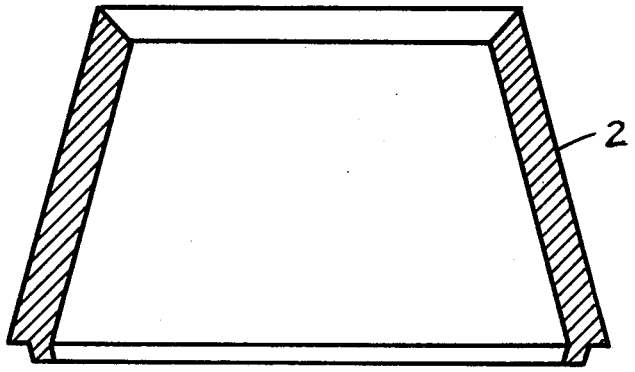
FIG. 6 is a vertical, cross-sectional view taken along line 6—6 of FIG. 5.

In operation, a beer keg K is first seated and centered by the upward projection P in the lower part 3, as shown in FIG. 4. Ice cubes or crushed ice is then packed in the space between the keg and the inner walls of part 3 (see FIG. 2), then the top half 2, of the construction shown FIGS. 5 and 6, is interlocked with the grooved mouth portion of part 3. Crushed ice is then introduced into the top opening (FIG. 6) of the upper part 2 so as to fill the space between the sidewalls and the container part 2 as well as to cover the top portion of the keg (see FIG. 2). Finally, the lid 1 is placed on the top of part 2 so as to completely enclose the beer keg. If supplemental centering of the keg is desired by means other than projection P, it may take the form of spaced small projections P2 either at the mouth of part 2 or 3, -or perhaps a separate ring (not shown).

When it is desired to move the keg assembly from one position to another, the handles 6 are grasped and the entire assembly can be readily lifted and carried, even by one person.

Thus it will be seen that I have provided an efficient insulating container for kegs of beer or other drinks, which container provides a space between the keg and inner walls, and which space can be filled with ice cubes or crushed ice which completely surrounds the keg so as to keep it very cold and prevent appreciable dissipation of the cold, even on very hot days; also I have provided an insulating container which is extremely light yet which is very strong, by virtue of a wire basket reinforcement, having handles for enabling very easy transportation of the keg, insulating container and ice, from one position to another While I have illustrated and described a single specific embodiment of my invention, it will be understood that this is by way of illustration only and that various changes and modifications are contemplated in my invention and within the scope of the following claims.

I claim:

1. A container assembly for keeping cool a keg containing beer or other liquid, comprising a barrel shaped keg having outer walls, a container comprising a bottom half of insulating material reinforced with a basket-like reinforcing material and in the shape of a tub, a top half of insulating material generally of the shape of an inverted tub and made in two parts including a detachable lid with a central opening through which a tap of said keg is projected, said top and bottom halves having mating mouth portions which readily and detachably fit together, said container being spaced from said outer walls of the keg for receiving ice therebetween, and handle portions on diametrically opposite sides of said basket-like reinforcing material for carrying said container and keg.

2. A container assembly as recited in claim 1 together with an upstanding central bulbous portion on the bottom wall of said bottom half for seating the central bottom portion of said keg, and centering means projecting radially inwardly in spaced relationship along the inner wall of the top portion of said bottom half for engaging and centering said keg.

3. A container assembly as recited in claim 1 together with a drain connected to lower portion of said bottom half.

4. A container assembly as recited in claim 1 wherein said basket like reinforcement is embedded in the insulation of said bottom half.

5. A container assembly as recited in claim 1 wherein said basket-like reinforcing material is separate from said insulating material but closely fitted thereon.

* * * * *